US007094321B2

(12) United States Patent
Krebber et al.

(10) Patent No.: US 7,094,321 B2
(45) Date of Patent: Aug. 22, 2006

(54) DEVICE FOR CONTROLLING THE GAS PRESSURE IN A COKE OVEN CHAMBER

(75) Inventors: Frank Krebber, Essen (DE); Manfred Stier, Bochum (DE); Helmut Dobert, Hattingen (DE)

(73) Assignee: Uhde GmbH, Dortmund (DE)

( * ) Notice: Subject to any disclaimer, the term of this patent is extended or adjusted under 35 U.S.C. 154(b) by 238 days.

(21) Appl. No.: 10/477,365

(22) PCT Filed: Mar. 23, 2002

(86) PCT No.: PCT/EP02/03286

§ 371 (c)(1),
(2), (4) Date: Nov. 12, 2003

(87) PCT Pub. No.: WO02/092725

PCT Pub. Date: Nov. 21, 2002

(65) Prior Publication Data

US 2004/0129553 A1 Jul. 8, 2004

(30) Foreign Application Priority Data

May 17, 2001 (DE) ..... 101 24 310

(51) Int. Cl.
*C10B 27/06* (2006.01)
*C10B 29/00* (2006.01)

(52) U.S. Cl. ..... 202/256; 202/258; 202/270; 201/35

(58) Field of Classification Search ..... 201/35; 202/105, 256, 270, 258; 137/14
See application file for complete search history.

(56) References Cited

U.S. PATENT DOCUMENTS 4,168,208 A * 9/1979 Althoff et al. ..... 202/254

(Continued)

FOREIGN PATENT DOCUMENTS

| | | |
|---|---|---|
| DE | 4424 874 | 1/1996 |
| EP | 0649 455 | 4/1995 |

(Continued)

OTHER PUBLICATIONS

Hofherr, K, et al: "Verbesserter umweltschutz durch . . . ", Mar. 2001, pp. 33-40—Int'l. Search Rept.

*Primary Examiner*—N. Bhat
(74) *Attorney, Agent, or Firm*—Collard & Roe, P.C.

(57) ABSTRACT

A device for controlling the gas pressure in a coke oven chamber, has an immersion cup, to which water is supplied, and with an immersion pipe which is connected to the gas space of the coke oven chamber and terminates in the, immersion cup. The immersion cup has an overflow and a closeable outflow.

To control the liquid level, an outflow pipe for water is provided, the inflow-side end of which projects into the immersion pipe and contains casing-side inflow orifices for the inflow of water. Within the outflow pipe is arranged a slide which is open on both end faces and which closes the inflow orifices of the outflow pipe in the longitudinal direction according to the position of said slide and forms a vertically adjustable overflow for the water flowing into the outflow pipe.

The inflow-side end of the outflow pipe is surrounded by a siphon pipe which closes the outflow pipe on the top side and which forms an annular duct for the inflow of water, this annular duct issuing into the immersion cup below the immersion pipe.

5 Claims, 4 Drawing Sheets

U.S. PATENT DOCUMENTS

| | | | | | |
|---|---|---|---|---|---|
| 4,194,951 | A | * | 3/1980 | Pries | 202/227 |
| 4,306,939 | A | * | 12/1981 | Wackerbarth | 201/1 |
| 5,609,731 | A | * | 3/1997 | Giertz et al. | 201/35 |

FOREIGN PATENT DOCUMENTS

| | | |
|---|---|---|
| WO | WO94 01513 | 1/1994 |

* cited by examiner

DEVICE FOR CONTROLLING THE GAS PRESSURE IN A COKE OVEN CHAMBER

CROSS REFERENCE TO RELATED APPLICATIONS

Applicants claim priority under 35 U.S.C. 119 of GERMAN Application No. 10124310.3 filed on May 17, 2001. Applicants also claim priority under 35 U.S.C. 365 of PCT/EP02/03286 filed on Mar. 23, 2002. The international application under PCT article 21(2) was not published in English.

DESCRIPTION

The invention relates to a device for controlling the gas pressure in a coke oven chamber, with an immersion cup, to which water is supplied, and with an immersion pipe which is connected to the gas space of the coke oven chamber and terminates in the immersion cup, the immersion cup having an overflow and a closeable outflow, and the immersion pipe being designed with an end portion, the free gas outlet cross section of which is dependent on the liquid level in the immersion cup.

Such a device is known from EP 0 649 455 B1. By the liquid level in the immersion cup being varied, the gas pressure of an associated coke oven chamber can be controlled as a function of the release of gas. The variation in the liquid level in the immersion cup takes place indirectly by the control of the water inflow and of the water outflow. In this case, balanced water levels are established, which are dependent on the static pressure of the water column in the immersion cup and on the free cross section of the outflow orifice and which change in the event of fluctuations in the inflow quantity or outflow quantity. If there is a technical defect on one of the devices for controlling the water inflow or water outflow, there is the risk that the balanced water level varies in an uncontrolled manner and the pressure in the coke oven chamber either rises too sharply or falls too sharply. In the event of a pressure rise, emissions via the oven seals may occur. In the event of a pressure drop, there is the risk of an ingress of air into the coke oven chamber, which may lead to overheating. Another disadvantage is that, for each coke oven chamber of a coke oven battery, it is necessary to have a complicated control for determining and metering the water inflows and water outflows during a carbonizing operation.

In an alternative version described in EP 0 649 455 B1 (FIG. 10), the immersion pipe has a telescopically lengthenable end piece. The control of the chamber pressure takes place by the end piece being immersed differently into the collecting sump of the immersion cup. owing to the large dimensions of the gas-carrying immersion pipe, a complicated mechanism for adjusting the end piece is necessary. A further problem is the sealing-off between the telescopic end piece and the immersion pipe.

The object on which the invention is based is to specify a device for controlling the gas pressure in a coke oven chamber, which allows a direct and accurate control of the liquid level in the immersion cup. It is to be set up in a simple way in structural terms and to ensure that the coke oven chamber operates reliably and in a simple way in control terms.

Proceeding from a device having the features described initially, the object is achieved, according to the invention, in that, to control the liquid level, an outflow pipe for water is provided, the inflow-side end of which projects into the immersion pipe and contains casing-side inflow orifices for the inflow of water, in that within the outflow pipe is arranged a slide which is open on both end faces and which closes the inflow orifices of the outflow pipe in the longitudinal direction according to the position of a said slide and forms a vertically adjustable overflow for the water flowing into the outflow pipe, and in that the inflow-side end of the outflow pipe is surrounded by a siphon pipe which closes the outflow pipe on the top side and which forms an annular duct for the inflow of water, said annular duct issuing into the immersion cup below the immersion pipe.

In the device according to the invention, the respective position of the top edge of the slide defines the height of the water level within the immersion cup. By means of adjusting movements of the slide, the water level can be controlled directly and with great accuracy. Control takes place within the immersion pipe and consequently on the gas supply side, where only slight swirlings of the water surface can occur. In contrast to the water surface outside the immersion pipe, which is swirled to a great extent by rising gas bubbles of the outflowing gas, the comparatively calm water surface within the immersion pipe allows a highly accurate setting and control of the liquid level. The siphon pipe, which is arranged at the inflow-side end of the outflow pipe and which closes the outflow pipe on the top side and forms an annular duct for the inflow of water, said annular duct issuing into the immersion cup below the immersion pipe, prevents gas from flowing out via the outflow pipe and from adversely influencing the control. By virtue of the arrangement of the siphon pipe, the gas is forced to follow the path from the immersion pipe through the water immersion of adjustable height or, when the immersion is not complete, through the free gas outlet cross section of the immersion pipe. The length of the siphon pipe is dependent on the required control range for setting the liquid level. It goes without saying that the lower edge of the siphon pipe must always be located below the water level set in the immersion cup, in order to prevent a gas discharge.

The immersion cup can be flooded by the slide being moved into its uppermost position and by the casing-side inflow orifices of the outflow pipe thereby being closed completely. An outflow of water from the immersion cup is then no longer possible via the outflow pipe. Within the immersion cup, a water column is established, which is determined by the overflow of the immersion cup. The water column is dimensioned such that the gas path between the gas space of the coke oven chamber and a crude-gas collector on the outflow side of the device is interrupted. In this operating position, the coke oven chamber can be opened and carbonized coke expelled.

The immersion cup can also be emptied completely by the outflow of the immersion cup being opened. With the immersion cup emptied, the gas space of the coke oven chamber is connected to a crude-gas collector on the outflow side of the device, without any throttling of the gas flow, so that gases are sucked away by means of the vacuum prevailing in the crude-gas collector. This operation position is required in order to suspend a coke oven chamber freshly filled with coal onto the crude-gas collector of a coke oven battery.

According to a preferred version of the invention, the outflow pipe is connected, as a moveable adjusting element, to a plug assigned to the outflow of the immersion cup, the water which flows out in the outflow pipe flowing out through a water duct of the plug sealing off the immersion cup. The plug can be moved into an open position by means of a lifting movement of the outflow pipe and frees the outflow of the immersion cup. In a further refinement, the invention teaches that an adjusting rod is connected to the slide. By means of a lifting movement of the adjusting rod, the slide can be moved against a stop of the outflow pipe and takes up the outflow pipe together with the firmly connected plug.

As a drive for actuating the adjusting rod, an actuating drive is expediently used, which, in the event of the failure of its drive energy, remains in the last control position, since this in each case constitutes a position in which the water level/gas pressure combination corresponds to a defined reliable operating state of the coke oven chamber. Since, in the device according to the invention, each control position of the actuating drive acting on the slide can immediately and directly be assigned a water level in the immersion cup, the water level will not change in the event of a technical defect of the actuating drive or after the failure of the drive energy. This is important, above all, in the removal of crude gas from the coke oven chamber, since, here, the pressure should neither rise too sharply nor fall too sharply. In the former case, emissions via the oven seals may occur; in the latter case, there is the risk of an ingress of air into the coke oven chamber and, as a result, possible damage due to overheating. The water level last set before the failure of an actuating drive at the same time, for this state, constitutes the reliable position for oven operation.

Further refinements of the device according to the invention are the subject matter of claims 4 and 5.

BRIEF DESCRIPTION OF THE DRAWINGS

The invention is described below with reference to a drawing which illustrates only one exemplary embodiment and in which, diagrammatically.

Figure 1A:
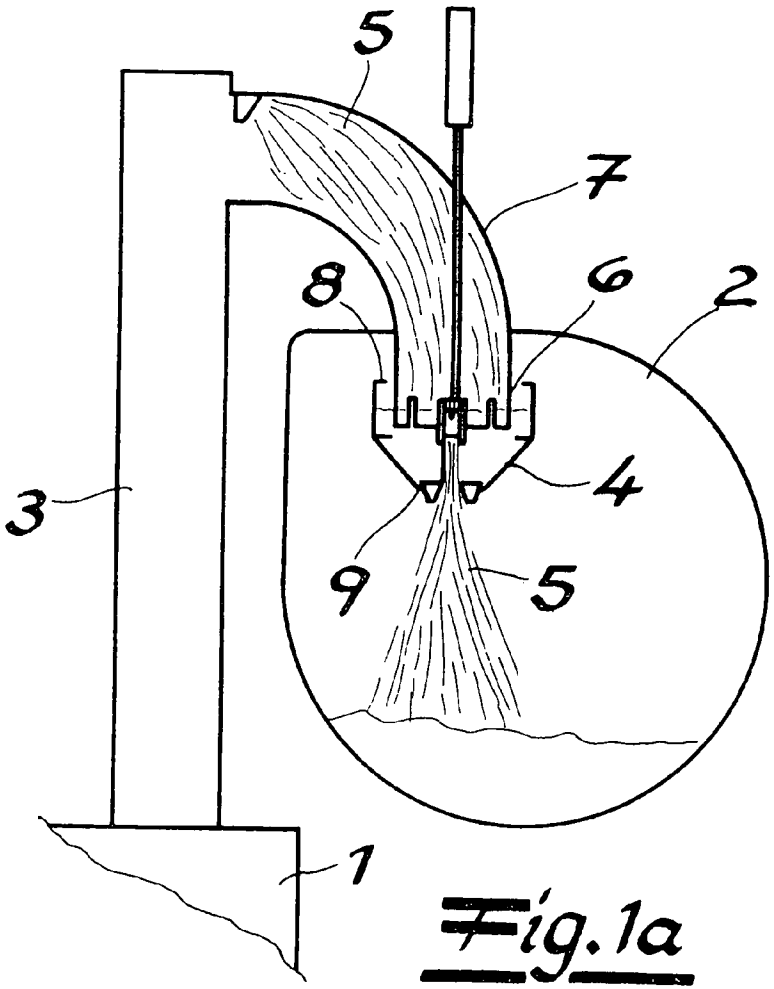
FIGS. 1*a* and 1*b* show a device, arranged in the gas path between a coke oven chamber and a crude-gas collector, for controlling the gas pressure in the coke oven chamber in different operating positions.
Figure 1B:
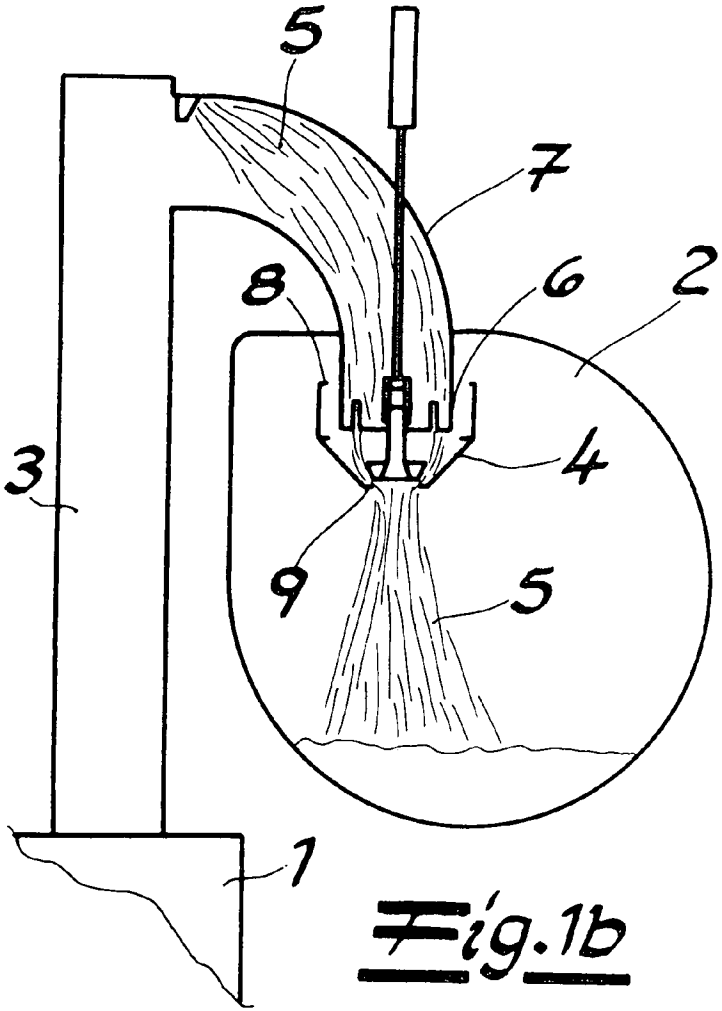
Figure 2:
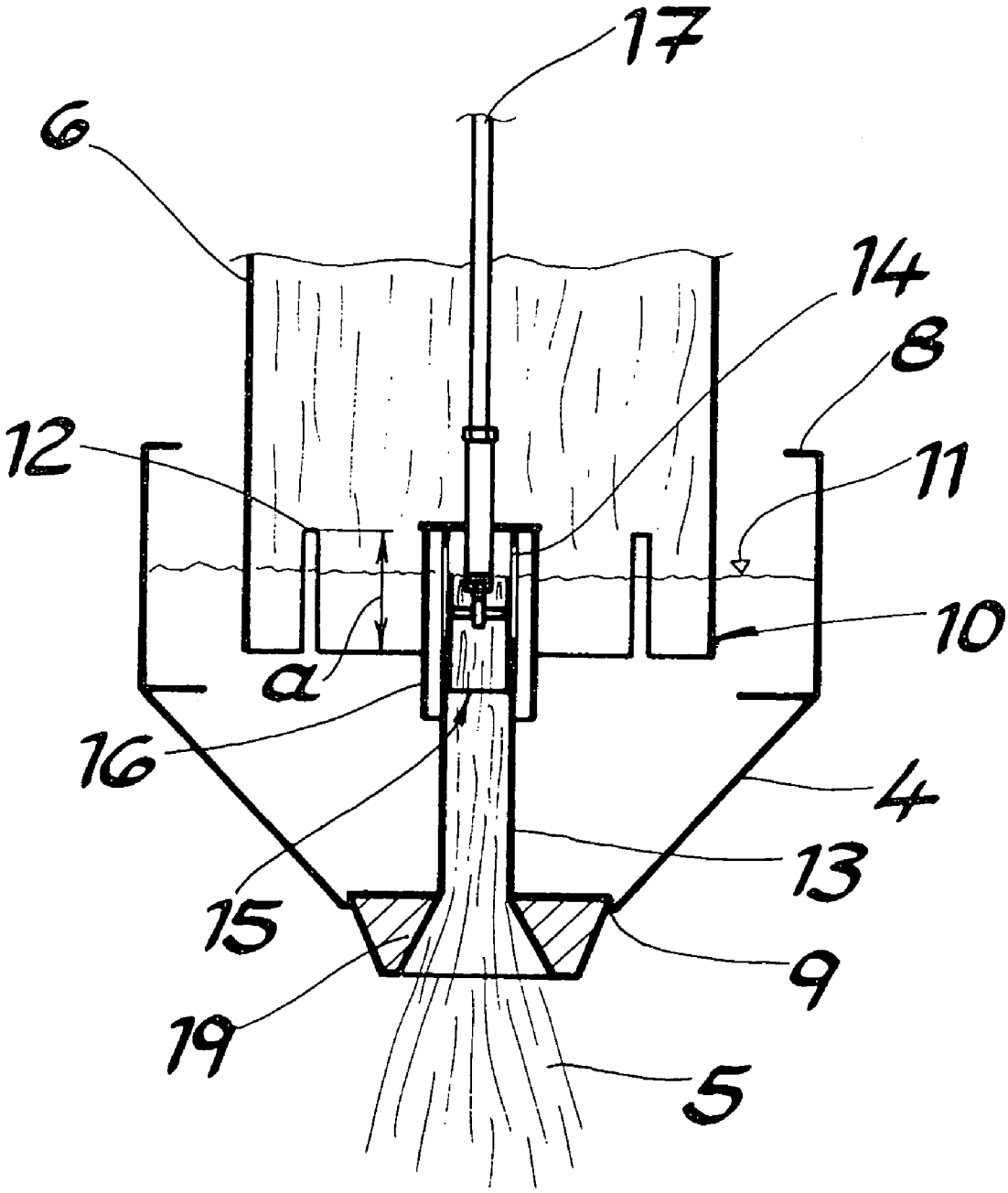
FIG. 2 shows a longitudinal section through the device in an illustration which is enlarged in relation to FIG. 1*a* and 1*b*, FIGS. 3 and 4 show other operating positions of the device illustrated in FIG. 2.

The device illustrated in the figures serves for controlling the gas pressure in a coke oven chamber 1 of a coke oven battery. It is arranged within a crude-gas collector 2 of the coke oven battery and is connected via a riser pipe 3 to the gas space of the coke oven chamber 1 (FIG. 1*a*, 1*b*). The basic setup of the device includes an immersion cup 4, to which water 5 is constantly supplied, and an immersion pipe 6 which is connected to the riser pipe 3 via a riser pipe elbow 7 and terminates in the immersion cup 4. The immersion cup 4 has an overflow 8 and a closeable outflow 9. The immersion pipe 6 is designed with an end portion 10, the free gas outlet cross section of which is dependent on the liquid level 11 in the immersion cup 4. In the exemplary embodiment, the end portion 10 has casing-side slots 12 (FIG. 2). Furthermore, the lower edge may be profiled or beveled.

It may be gathered from FIG. 2 that, in order to control the liquid level 11, an outflow pipe 13 for water is provided, the inflow-side end of which projects into the immersion pipe 6 and contains casing-side inflow orifices 14 for the inflow of water. Within the outflow pipe 13 is arranged a slide 15 which is open on both end faces and which closes the inflow orifices 14 of the outflow pipe 13 in the longitudinal direction according to the position of said slide and forms a vertically adjustable overflow for the water flowing into the outflow pipe 13. The inflow-side end of the outflow pipe 13 is surrounded by a siphon pipe 16 which closes the outflow pipe 13 on the top side and which forms an annular duct for the inflow of water, said annular duct issuing into the immersion cup 4 below the immersion pipe 6. The top edge of the slide 15 defines the height of the water level within the immersion cup 4. The siphon pipe 16 in this case prevents the situation where gas can flow through the outflow pipe 13 and adversely influence the water level control.

The casing-side recesses 12 in the end portion 10 of the immersion pipe 6, said recesses being, for example, of slot-shaped design, extend in the longitudinal direction over a portion a, the length of which is adapted to the adjustment range of the slide 15 within the outflow pipe 13.

The slide 15 can be moved by means of an adjusting rod 17 which is led through a portion of the immersion pipe 6. Said adjusting rod is led through the wall of the riser pipe elbow 7, the elongation of which constitutes the immersion pipe 6, is guided outward and is connected there to a suitable actuating drive 18 (FIG. 1*a*, 1*b*). What is expediently used as an actuating drive 18 is a drive assembly which, in the event of a failure of its drive energy, remains in the last control position, since this constitutes that position in which the water level/gas pressure combination corresponds to a defined reliable state. This is important, above all, in the removal of crude gas from the coke oven chamber, since, here, the pressure should neither rise too sharply nor fall too sharply. In the case of an uncontrolled pressure rise, there is the risk of emission via the oven seals; in the event of a pressure drop, a discharge of air into the coke oven chamber is possible, which could lead to damage due to overheating. The last controlled water level before the failure of the drive energy of the actuating drive 18 or before any other fault of the actuating drive 18 at the same time, for this state, constitutes the reliable position for oven operation.

Figure 3:
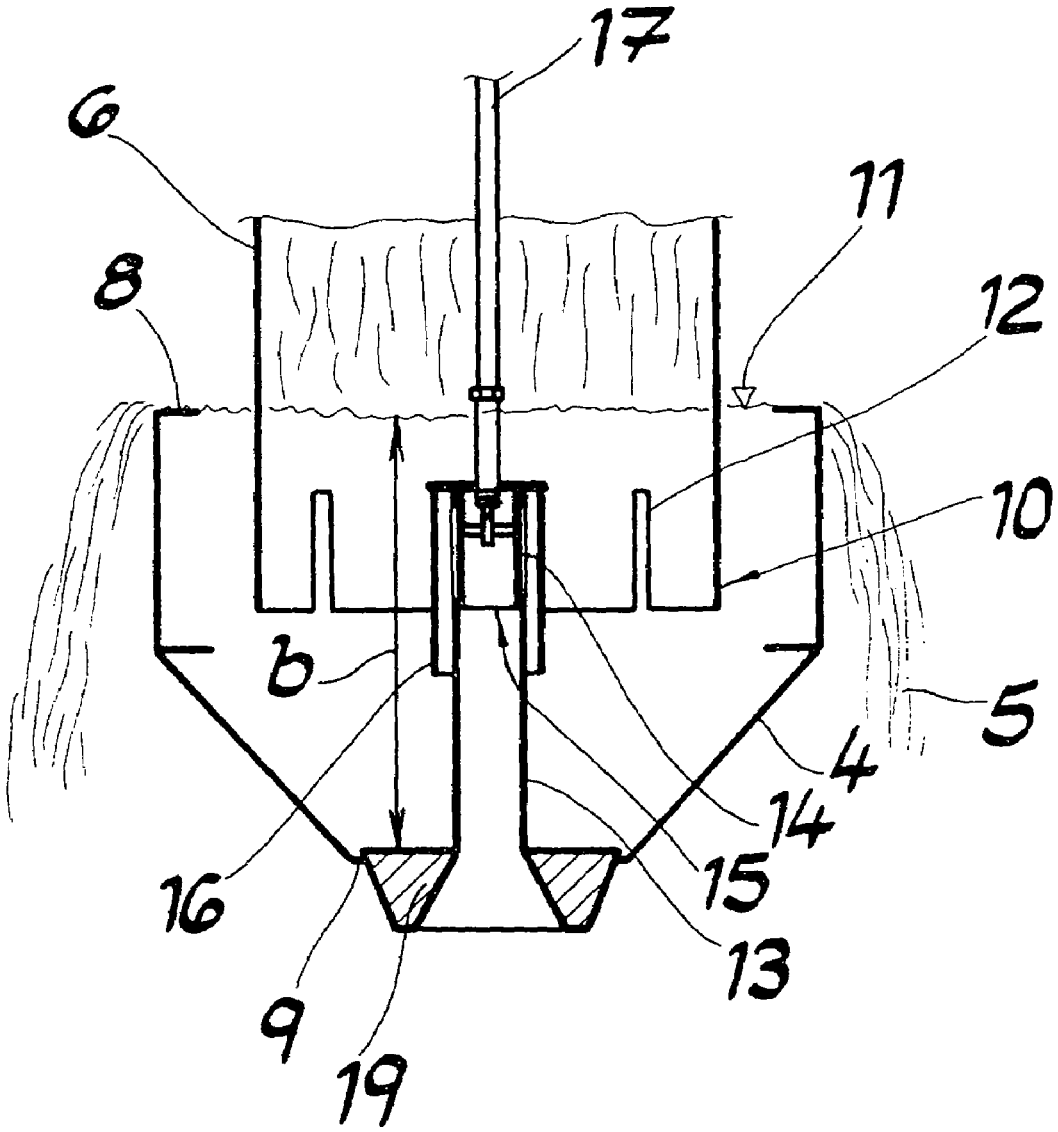

In the operating position of the device, as illustrated in FIG. 3, the casing-side inflow orifices 14 of the outflow pipe 13 which are designed, for example, as longitudinal slots are closed by means of the slide 15. The immersion cup 4 is flooded by the inflowing water. The water flows out via the overflow 8 of the immersion cup 4. The liquid column b in the immersion pipe 6 is such that the gas path between the gas space of the coke oven chamber 1 and the crude-gas collector 2 is interrupted. The coke oven chamber 1 can be opened and carbonized coke expelled. The device according to the invention prevents the situation where air may pass into the crude-gas collector 2.

The outflow pipe 13 is connected, as a moveable adjusting element, to a plug 19 assigned to the outflow 9, the water which flows out in the outflow pipe 13 flowing out through a water duct of the plug 19 sealing off the immersion cup 4 (FIGS. 1*a* and 2). The plug 19 can be moved into the open position, illustrated in FIG. 4, by means of a lifting movement of the outflow pipe 13 and frees the outflow 9 of the immersion cup 4 for emptying the immersion cup. The device according to the invention assumes the operating position illustrated in FIG. 4 when the associated coke oven chamber 1 is freshly filled with coal. The filling gases are sucked away, unthrottled, into the crude-gas collector 2 by means of the vacuum prevailing in the crude-gas collector 2.

Figure 4:
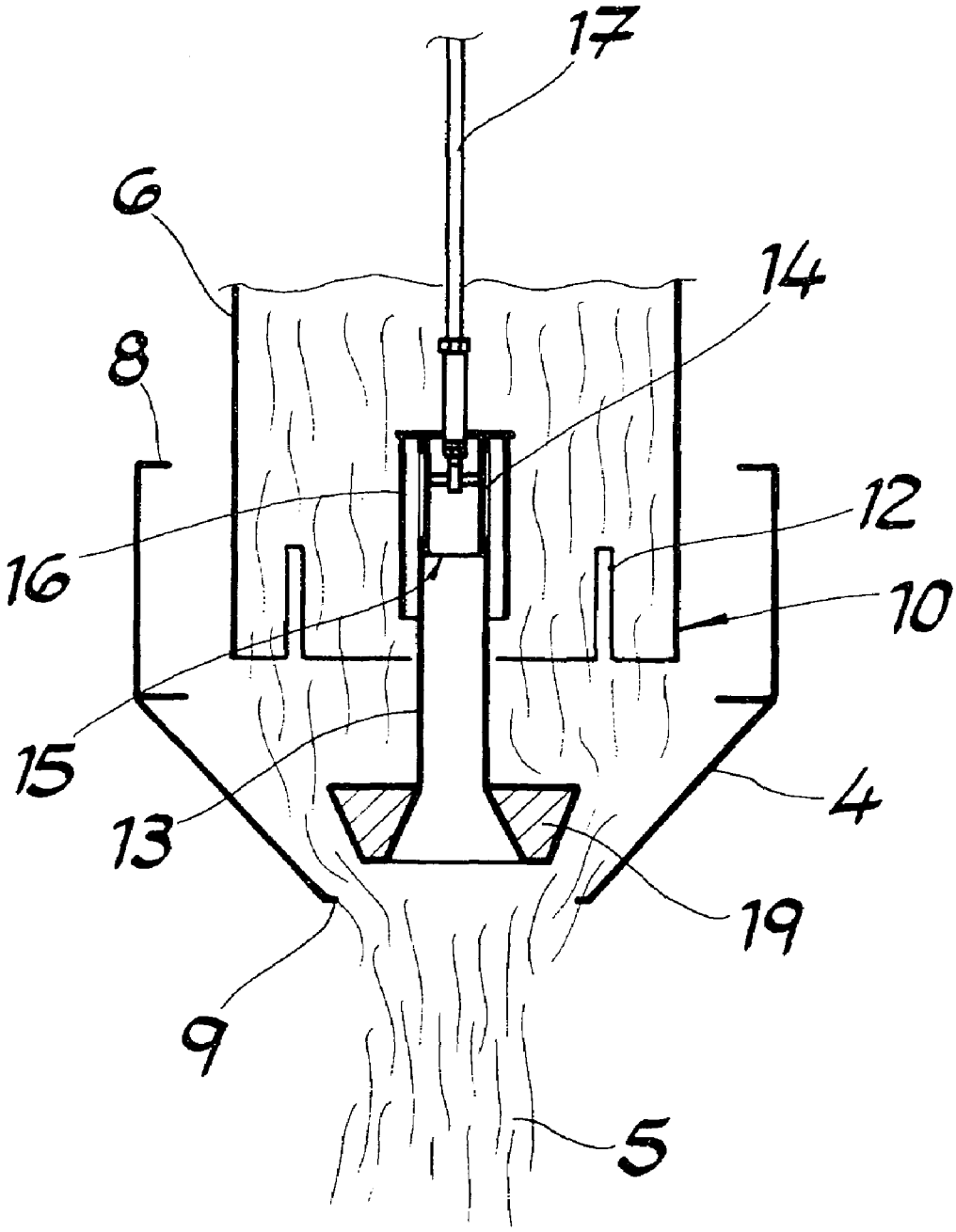

By means of the device according to the invention, the complete operating cycle of a coke oven chamber can be controlled or regulated. To load the coke oven chamber 1 with coal, the immersion cup 4 is emptied completely, so that the filling gases can be sucked away, unthrottled, into the crude-gas collector 2 by means of the vacuum prevailing in the crude-gas collector 2. During the carbonization time, the chamber pressure is controlled according to a stipulated value by the control of the liquid level in the device according to the invention. To expel the carbonized coke from the coke oven chamber 1, the gas path is interrupted by the flooding of the immersion cup 4, so that no air can pass into the crude-gas collector 2. It may be gathered from a comparative look at the figures that the control, closing and opening of the gas path take place by means of a codirectional movement of the slide 15. By means of the adjusting movements of the slide 15, the liquid level can be controlled (FIG. 2). By means of a further adjusting movement of the slide, the inflow orifices 14 of the outflow pipe 13 can be closed (FIG. 3). The slide 15 can be moved against a stop, for example the upper cover of the outflow pipe 13, and, during the further lifting movement, takes up the outflow pipe 13 together with the firmly connected plug 19, the outflow 9 of the immersion cup 4 being opened (FIG. 4). In the sequence of operating steps, the necessary adjusting movements of the adjusting rod 17 are small, so that the operating steps can be executed quickly.

The invention claimed is:

1. A device for controlling the gas pressure in a coke oven chamber, comprising an immersion cup (4), to which water is supplied, and with an immersion pipe (6) which is connected to the gas space of the coke oven chamber (1) and terminates in the immersion cup, the immersion cup (4) having an overflow (8) and a closeable outflow (9), and the immersion pipe (6) being designed with an end portion (10), the free gas outlet cross section of which is dependent on the liquid level (11) in the immersion cup (4), wherein, to control the liquid level (11), an outflow pipe (13) for water is provided, the inflow-side end of which projects into the immersion pipe (6) and contains casing-side inflow orifices (14) for the inflow of water, in that within the outflow pipe (13) is arranged a slide (15) which is open on both end faces and which closes the inflow orifices (14) of the outflow pipe (13) in the longitudinal direction according to the position of said slide and forms a vertically adjustable overflow for the water flowing into the outflow pipe (13), in that the inflow-side end of the outflow pipe (13) is surrounded by a siphon pipe (16) which closes the outflow pipe (13) on the top side and which forms an annular duct for the inflow of water, said annular duct issuing into the immersion cup (4) below the immersion pipe (6), and in that the respective position of the top edge of the slide (15) defines the height of the water level within the immersion cup (4).

2. The device as claimed in claim 1, wherein the outflow pipe (14) is connected, as a moveable adjusting element, to a plug (19) assigned to the outflow (9) of the immersion cup (4), the water which flows out in the outflow pipe (13) flowing out through a water duct of the plug (19) sealing off the immersion cup (4), and in that the plug (19) can be moved into an open position by means of a lifting movement of the outflow pipe (13) and frees the outflow (9) of the immersion cup (4).

3. The device as claimed in claim 1, wherein the slide (15) has connected to it an adjusting rod (17), by means of the lifting movement of which the inflow orifices (14) of the outflow pipe (13) can be closed, and in that, by means of a further lifting movement of the adjusting rod (17), the slide (15) can be moved against a stop of the outflow pipe (13) and takes up the outflow pipe (13) together with the firmly connected plug (19).

4. The device as claimed in claim 3, wherein the adjusting rod (17) is led through a portion of the immersion pipe (6).

5. The device as claimed in claim 1, wherein the end portion (10) of the immersion pipe (6) has casing-side recesses (12) which extend in the longitudinal direction over a portion (a), the length of which is adapted to the adjustment range of the slide (15) within the outflow pipe (13).

* * * * *